US005682904A

United States Patent [19]

Stinnett

[11] Patent Number: 5,682,904

[45] Date of Patent: Nov. 4, 1997

[54] MOUTHPIECE HAVING A CAVITY PORTION

[76] Inventor: Thomas M. Stinnett, 4923 Heathmoore Ct., Louisville, Ky. 40242-1875

[21] Appl. No.: 596,618

[22] Filed: Feb. 5, 1996

[51] Int. Cl.[6] ..... A61C 5/14

[52] U.S. Cl. ..... 128/861; 128/862

[58] Field of Search ..... 128/848, 859–862; 433/32, 215, 229

[56] References Cited

U.S. PATENT DOCUMENTS

| | | | |
|---|---|---|---|
| 2,750,941 | 6/1956 | Cathcart | 128/136 |
| 2,827,899 | 3/1958 | Altieri | 128/136 |
| 3,527,219 | 9/1970 | Greenberg | 128/260 |
| 3,532,091 | 10/1970 | Lerman | 128/862 |
| 4,983,122 | 1/1991 | Mitnick | 433/229 |
| 5,082,007 | 1/1992 | Adell | 128/859 |
| 5,323,787 | 6/1994 | Pratt | 128/861 |
| 5,415,544 | 5/1995 | Oxman | 433/48 |

*Primary Examiner*—Michael A. Brown

*Attorney, Agent, or Firm*—Middleton & Reutlinger; James C. Eaves, Jr.

[57] ABSTRACT

The present invention relates to a mouthpiece having a cavity portion. The cavity portion can be filled with a fluid and frozen. When worn, the frozen fluid will thaw and the fluid can drip into the wearer's mouth through openings in the cavity bottom.

11 Claims, 1 Drawing Sheet

MOUTHPIECE HAVING A CAVITY PORTION

BACKGROUND OF THE INVENTION (a) Field of the Invention

The present invention relates to a mouthpiece having a cavity portion. The cavity portion can be filled with a fluid and frozen. When worn, the frozen fluid will thaw and the fluid will drip into the wearer's mouth through openings in the cavity bottom.

(b) Description of the Prior Art

U.S. Pat. Nos. 2,827,899 and 3,527,219 teach U-shaped or horseshoe-shaped tooth guards. U.S. Pat. Nos. 2,750,941 and 5,323,787 teach U-shaped mouthpieces having a center palate portion within the U-shaped opening.

SUMMARY OF THE INVENTION

The present invention is for a mouthpiece having a cavity portion. The cavity portion can be filled with a fluid and frozen. When worn, the frozen fluid will thaw and the fluid will drip into the wearer's mouth through openings in the cavity bottom.

For example, a boxer could have a plurality of mouthpieces having a frozen fluid therein with him at the boxing ring. A new mouthpiece could be used for each round.

The mouthpiece of the present invention includes an arcuate or U-shaped body portion and a center cavity portion. The U-shaped body portion has a U-shaped channel to receive the wearer's upper teeth. The center cavity portion is formed in the inside of the U-shaped opening. It has a solid top and rear and a bottom with a plurality of openings therein. These openings receive the fluid to be frozen, for example, water, and permit the thawing fluid to drip into the wearer's mouth.

Finally, the present invention comprises a mouthpiece, having a generally U-shaped body portion having an outer leg, an inner leg, and a base; the outer leg and the inner leg being in a substantially parallel relationship, the base connecting the inner and outer legs; the inner leg having a pair of ends and an upper portion and a lower portion, the inner leg and an imaginary plane connecting the pair of ends defining a cavity; and, a center cavity portion having a top, a bottom, and a rear, the bottom having at least one opening therein, the top extending from the inner leg upper portion to the inner leg pair of ends, the bottom extending from the inner leg lower portion to the inner leg pair of ends, and the rear extending from the top and the bottom to said inner leg pair of ends.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
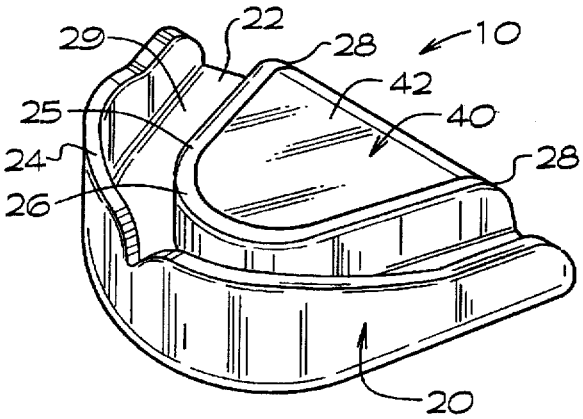
FIG. 1 shows a perspective view of the mouthpiece of the preferred embodiment.

With reference to the figures, the preferred embodiment of the mouthpiece 10 is shown. Mouthpiece 10 would, for example, be made of a soft, pliable elastomeric material, although other Materials of construction could be used by those skilled in the art.

Mouthpiece 10 is shown having a arcuate or U-shaped body portion 20 and a center cavity portion 40. Portion 20 has a U-shaped channel 22 which receives a wearer's upper teeth. Channel 22 includes substantially parallel upstanding legs 24 and 25, interconnected by a connecting base 29. In use, leg 24 is in front of the wearer's teeth, leg 25 is behind the wearer's teeth, and base 29 is below the wearer's upper teeth. The shapes of the legs can be varied as desired. U-shaped leg 25 has opposed ends 28 and upper portion 26 and lower portion 27.

Center cavity portion 40 provides a means for holding a fluid and is shown having a top 42, a bottom 44 having a plurality of openings 46 therein, and a rear 48. The inner U-shaped portion of leg 25 and top 42, bottom 44, and rear 48 form the center cavity portion 40. Instead of using leg 25, a separate member could be used to form a cavity piece which could be attached to a leg 25. Therefore, the mouthpiece with center cavity portion may be a one-piece construction, or two-piece construction.

Figure 2:
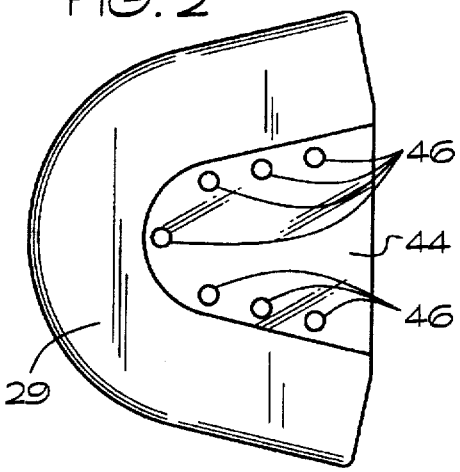
FIG. 2 shows a bottom plan view of the mouthpiece of the preferred embodiment of FIG. 1.
Figure 4:
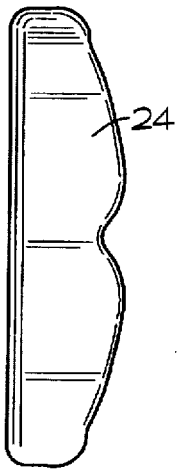
FIG. 4 shows a front plan view of the preferred embodiment of FIG. 1.
Figure 3:
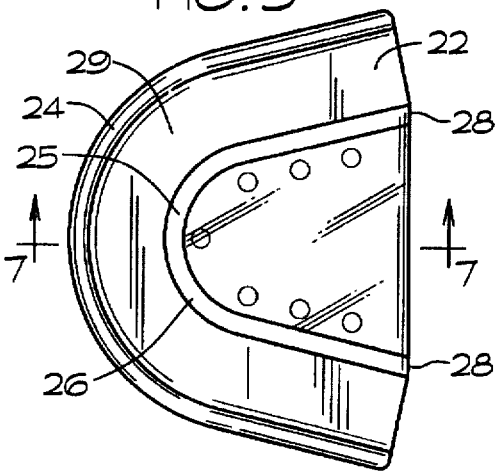
FIG. 3 shows a top plan view of the preferred embodiment of FIG. 1.
Figure 5:
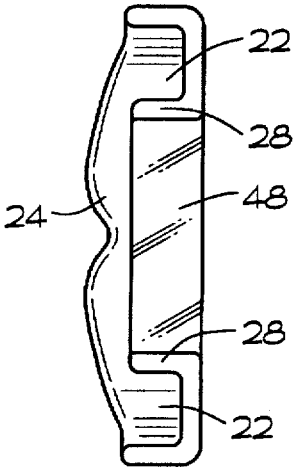
FIG. 5 shows a rear plan view of the preferred embodiment of FIG. 1.
Figure 6:
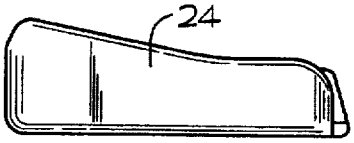
FIG. 6 shows a left side plan view of the preferred embodiment of FIG. 1.
Figure 7:
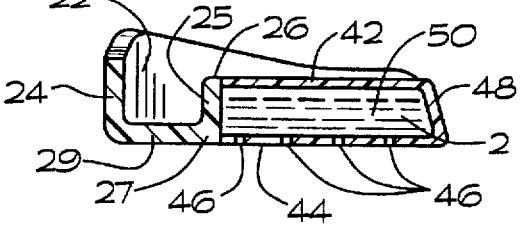
FIG. 7 shows a cross-section view of a portion of the mouthpiece along the lines 7—7 of FIG. 3.

With the mouthpiece 10 in a bottom 44 upward position, such as shown in FIG. 2, one can pour a fluid to be frozen into openings 46. The mouthpiece 10 is then placed in a freezer and the fluid frozen. For example, FIG. 7 shows water/ice 2 contained in cavity 50. Any desired fluid can be used. The mouthpiece 10 with frozen fluid therein is removed from the freezer for use. Over time, the frozen fluid melts and the fluid passes through openings 46 to drip into the wearer's mouth.

If desired, openings 46 could be omitted from bottom 44. Then, a fluid, such as a gel or water, which could be refrozen for subsequent uses of the mouthpiece could be contained within a then sealed cavity 50. When worn, the mouthpiece with the frozen fluid would cool the wearer's mouth, but not provide fluid.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A mouthpiece, comprising:

a. a generally U-shaped body portion, said U-shaped body portion having an outer leg, an inner leg, and a base; said outer leg and said inner leg being in a substantially parallel relationship, said base connecting said inner and outer legs; said inner leg having a pair of ends and an upper portion and a lower portion; and, b. a center cavity portion, said center cavity portion having a top, a bottom, and a rear, said bottom having at least one opening therein, said top extending from said inner leg upper portion to said inner leg pair of ends, said bottom extending from said inner leg lower portion to said inner leg pair of ends, and said rear extending from said top and said bottom to said inner leg pair of ends.

2. The mouthpiece of claim 1, where said mouthpiece is of one-piece construction.

3. The mouthpiece of claim 1, where said generally U-shaped body portion is a first piece and where said center cavity portion is a second piece, said first and said second piece being joined.

4. The mouthpiece of claim 1, where said at least one opening thereinto said bottom comprises a plurality of openings.

5. The mouthpiece of claim 4, where said center cavity portion contains a fluid.

6. The mouthpiece of claim 1, where said center cavity portion contains a fluid.

7. A mouthpiece, comprising:

a. a generally U-shaped body portion, said U-shaped body portion having an outer leg, an inner leg, and a base; said outer leg and said inner leg being in a substantially parallel relationship, said base connecting said inner and outer legs; said inner leg having a pair of ends and an upper portion and a lower portion; and, b. a center cavity portion, said center cavity portion having a top, a bottom, and a rear, said top extending from said inner leg upper portion to said inner leg pair of ends, said bottom extending from said inner leg lower portion to said inner leg pair of ends, and said rear extending from said top and said bottom to said inner leg pair of ends, where said center cavity portion contains a fluid which may be frozen to cool the mouthpiece wearer's mouth.

8. A mouthpiece, comprising: a generally U-shaped body portion, said U-shaped body portion having an outer leg, an inner leg, and a base; said outer leg and said inner leg being in a substantially parallel relationship, said base connecting said inner and outer legs; said inner leg having a pair of ends and an upper portion and a lower portion, said inner leg and an imaginary plane connecting said pair of ends defining a cavity, said cavity including means for holding a fluid, said means for holding containing a fluid which may be frozen to cool the mouthpiece wearer's mouth.

9. The mouthpiece of claim 8, said means for holding a fluid including a top, a bottom, and a rear, said top extending from said inner leg upper portion to said inner leg pair of ends, said bottom extending from said inner leg lower portion to said inner leg pair of ends, and said rear extending from said top and said bottom to said inner leg pair of ends.

10. The mouthpiece of claim 9, said bottom having at least one opening therein.

11. The mouthpiece of claim 8, said means for holding a fluid having at least one opening therein.

* * * * *